US009217619B2

(12) United States Patent
Fonte

(10) Patent No.: US 9,217,619 B2
(45) Date of Patent: Dec. 22, 2015

(54) COMPOSITE GUN BARREL WITH OUTER SLEEVE MADE FROM SHAPE MEMORY ALLOY TO DAMPEN FIRING VIBRATIONS

(71) Applicant: ATI Properties, Inc., Albany, OR (US)

(72) Inventor: Matthew V. Fonte, Concord, MA (US)

(73) Assignee: ATI PROPERTIES, INC., Albany, OR (US)

( * ) Notice: Subject to any disclaimer, the term of this patent is extended or adjusted under 35 U.S.C. 154(b) by 0 days.

(21) Appl. No.: 14/320,992

(22) Filed: Jul. 1, 2014

(65) Prior Publication Data

US 2015/0247693 A1 Sep. 3, 2015

Related U.S. Application Data

(63) Continuation of application No. 13/411,290, filed on Mar. 2, 2012, now Pat. No. 8,869,443.

(60) Provisional application No. 61/448,237, filed on Mar. 2, 2011.

(51) Int. Cl.

| | |
|---|---|
| ***F41A 21/00*** | (2006.01) |
| ***F41A 21/04*** | (2006.01) |
| ***F41A 21/36*** | (2006.01) |

(52) U.S. Cl.

CPC ..... *F41A 21/04* (2013.01); *F41A 21/36* (2013.01)

(58) Field of Classification Search

USPC ..... 42/76.01, 77, 78, 76.1

See application file for complete search history.

(56) References Cited

U.S. PATENT DOCUMENTS

| | | | |
|---|---|---|---|
| 1,346,188 | A | 7/1920 | Fahrenwald |
| 1,365,987 | A | 1/1921 | Hadfield et al. |
| 1,384,718 | A | 7/1921 | Guy |
| 1,553,825 | A | 9/1925 | Langenberg |
| 1,602,282 | A | 10/1926 | Methlin |
| 2,104,319 | A | 1/1938 | Dicke |
| 2,541,114 | A | 2/1951 | Somes |
| 2,541,116 | A | 2/1951 | Somes |
| 2,876,095 | A | 3/1959 | Dickerson |
| 2,990,342 | A | 6/1961 | Sullivan |

(Continued)

FOREIGN PATENT DOCUMENTS

| | | | |
|---|---|---|---|
| EP | 0614712 | A1 | 9/1994 |
| JP | 1-130822 | A | 5/1989 |

OTHER PUBLICATIONS

"White Paper Autofrettage." Maximator Test, LLC, 4 pages.

(Continued)

*Primary Examiner* — Samir Abdosh

(74) *Attorney, Agent, or Firm* — K&L Gates LLP

(57) ABSTRACT

According to one aspect, a composite gun barrel comprises an inner rifled liner tube having an outer surface, and an outer sleeve comprising a shape memory alloy and having an inner surface disposed against the outer surface of the inner rifled liner tube. The inner rifled liner tube is configured for guiding projectiles and the outer sleeve is configured for dampening the firing vibrations encountered by the inner rifled liner tube. A method for forming a composite gun barrel comprises providing an inner rifled liner tube having an outer surface. A sleeve made from a shape memory alloy and having an inner surface is provided. The outer sleeve is disposed about the inner rifled liner tube so that the inner surface of the outer sleeve substantially engages the outer surface of the inner rifled liner tube.

31 Claims, 10 Drawing Sheets

(56) References Cited

U.S. PATENT DOCUMENTS

| | | | | |
|---|---|---|---|---|
| 3,017,793 | A | 1/1962 | Appel | |
| 3,091,022 | A | 5/1963 | Faulkner | |
| 3,516,326 | A | 7/1970 | Donner | |
| 3,571,962 | A | 3/1971 | Eig | |
| 3,626,570 | A | 12/1971 | Kushnir et al. | |
| 3,660,177 | A | 5/1972 | Brown et al. | |
| 3,969,155 | A | 7/1976 | McKeighen | |
| 4,359,352 | A | 11/1982 | Ray et al. | |
| 4,409,881 | A | 10/1983 | van der Wielen | |
| 4,411,569 | A | 10/1983 | Pizzola | |
| 4,417,459 | A | 11/1983 | Tomita | |
| 4,482,398 | A | 11/1984 | Eylon et al. | |
| 4,571,969 | A | 2/1986 | Tomita | |
| 4,622,080 | A | 11/1986 | Wegwerth | |
| 4,638,712 | A | 1/1987 | Chawla et al. | |
| 4,669,212 | A | 6/1987 | Jackson et al. | |
| 4,747,225 | A | 5/1988 | Gstettner et al. | |
| 4,756,677 | A | 7/1988 | Hribernik et al. | |
| 4,911,060 | A | 3/1990 | Greenspan et al. | |
| 5,004,529 | A | 4/1991 | Vishnitsky | |
| 5,154,780 | A | 10/1992 | Premkumar | |
| 5,160,802 | A | 11/1992 | Moscrip | |
| 5,341,719 | A | 8/1994 | Bullis et al. | |
| 5,344,508 | A | 9/1994 | Gilman et al. | |
| 5,470,373 | A | 11/1995 | Edelstein et al. | |
| 5,649,440 | A | 7/1997 | Arnautu et al. | |
| 5,856,631 | A * | 1/1999 | Julien | 89/16 |
| 5,928,799 | A | 7/1999 | Sherman et al. | |
| 5,935,351 | A | 8/1999 | Sherman et al. | |
| 6,038,901 | A | 3/2000 | Stein et al. | |
| 6,068,814 | A | 5/2000 | Kang et al. | |
| 6,167,794 | B1 | 1/2001 | Kathe | |
| 6,298,764 | B1 | 10/2001 | Sherman et al. | |
| 6,363,867 | B1 * | 4/2002 | Tsilevich | 109/49.5 |
| 6,422,010 | B1 | 7/2002 | Julien | |
| 6,523,385 | B2 | 2/2003 | Häusler | |
| 6,564,689 | B1 | 5/2003 | Billgren | |
| 6,594,936 | B1 | 7/2003 | Sniezak et al. | |
| 6,615,702 | B1 | 9/2003 | Julien | |
| 6,810,615 | B2 | 11/2004 | Hermanson et al. | |
| 6,880,220 | B2 | 4/2005 | Gandy | |
| 6,887,356 | B2 | 5/2005 | Ford et al. | |
| 6,908,516 | B2 | 6/2005 | Hehmann et al. | |
| 6,913,791 | B2 | 7/2005 | Burca et al. | |
| 6,923,900 | B2 | 8/2005 | Jones et al. | |
| 6,931,776 | B2 | 8/2005 | Wagner et al. | |
| 7,482,065 | B2 | 1/2009 | Branagan | |
| 7,520,947 | B2 | 4/2009 | Kennedy et al. | |
| 7,601,232 | B2 | 10/2009 | Fonte et al. | |
| 7,721,478 | B2 | 5/2010 | Withers et al. | |
| 7,818,986 | B1 | 10/2010 | Parker et al. | |
| 7,921,590 | B2 | 4/2011 | Briggs et al. | |
| 7,934,332 | B2 | 5/2011 | Briggs | |
| 7,963,202 | B1 | 6/2011 | Becker et al. | |
| 8,075,839 | B2 | 12/2011 | Srivastava | |
| 8,302,341 | B2 * | 11/2012 | Fonte | 42/76.1 |
| 8,388,890 | B2 | 3/2013 | Hilty et al. | |
| 8,418,392 | B2 | 4/2013 | Carter et al. | |
| 8,479,549 | B1 | 7/2013 | Fonte | |
| 8,671,609 | B2 | 3/2014 | Fonte | |
| 8,869,443 | B2 | 10/2014 | Fonte | |
| 2003/0019269 | A1 | 1/2003 | Rolf | |
| 2005/0066801 | A1 | 3/2005 | Hermanson et al. | |
| 2005/0076975 | A1 | 4/2005 | Lopez et al. | |
| 2005/0194073 | A1 | 9/2005 | Hamano et al. | |
| 2005/0279630 | A1 | 12/2005 | Fonte | |
| 2006/0288854 | A1 | 12/2006 | Witherell et al. | |
| 2009/0217812 | A1 | 9/2009 | Whitaker et al. | |
| 2010/0236122 | A1 | 9/2010 | Fonte | |

OTHER PUBLICATIONS

Aguayo et al., "Elastic Stability and Electronic Structure of fcc Ti, Zr, and Hf: A First-principles Study," Physical Review B, vol. 65, 092106, 4 pages, Feb. 2002.

Alegre et al., "Fatigue design of wire-wound pressure vessels using ASME-API 579 procedure," Eng Fail Anal, pp. 1-12, 2009.

Andrews et al., "Hydraulic Testing of Ordnance Components," ASME, vol. 128, pp. 162-167, May 2006.

Burton et al., "Army Materials Research: Transforming Land Combat Through New Technologies," AMPTIAC Quarterly, vol. 8, No. 4, 10 pages, 2004.

Del Corso, "Effect of Cold Drawing & Heat Treating on Powder Metallurgy Processed ASTM F 1537 Alloy 1 & Alloy 2 Barstock," Carpenter Technology Corporation, Reading, PA, 6 pages, 2003.

Gloaguen et al., "Measurement and Prediction of Residual Stresses and Crystallographic Texture Development in Rolled Zircaloy-4 Plates: X-ray Diffraction and the Self-Consistent Model," Acta Materialia, vol. 55, pp. 4369-4379, 2007.

Janaki Ram et al., "Microstructure and Wear Properties of LENS@ Deposited medical Grade CoCrMo," J. Mater Sci: Mater Med, vol. 19, pp. 2105-2111, 2008.

Mani Krishna et al, "Microstructural and Textural Developments During Zircaloy-4 Fuel Tube Fabrication," Journal of Nuclear Materials, vol. 383, pp. 78-85, 2008.

Mani-Medrano et al., "Effect of Plastic Deformation on the Isothermal FCC/HCP Phase Transformation During Aging of Co-27Cr-5Mo-0.05C Alloy," Materials Science Forum, vol. 560, pp. 23-28, 2007.

Montero-Ocampo et al., "Effect of Fcc-Hcp Phase Transformation Produced by Isothermal Aging on the Corrosion Resistance of a Co-27CR-5Mo-0.05C Alloy," Metallurgical and Materials Transactions A, vol. 33A, pp. 2229-2235, Jul. 2002.

Opris et al., "Development of Stellite Alloy Composites with Sintering/HIPing Technique for Wear-Resistant Applications," Materials & Design, vol. 28, pp. 581-591, 2007.

Parker et al., "Residual Stresses and Lifetimes of Tubes Subjected to Shrink Fit Prior to Autofrettage," ASME, vol. 125, pp. 282-286, Aug. 2003.

Paul et al., "Hot Working Characteristics of Cobalt in the Temperature Range 600-950° C," Scripta Materialia, vol. 60, pp. 104-107, 2009.

Perry et al., "The Influence of the Bauschinger Effect on the Yield Stress, Young's Modulus, and Poisson's Ratio of a Gun Barrel Steel," Journal of Pressure Vessel Technology, vol. 128, pp. 179-184, May 2006.

Robertson et al., "Crystallographic Texture for Tube and Plate of the Superelastic/Shape-Memory Alloy Nitinol Used for Endovascular Stents," Wiley InterScience, pp. 190-199, 2004.

Robertson et al., "Effect of Product Form and Heat Treatment on the Crystallographic Texture of Austenitic Nitinol," J. Mater Sci, vol. 41, pp. 621-630, 2006.

Theaker et al., "Development of Crystallographic Texture in CANDU Calandria Tubes," Thirteenth International Symposium, ASTM STP, pp. 445-464, 2002.

Yu et al., "A Comparison of the Tribo-Mechanical Properties of a Wear Resistant Cobalt-Based Alloy Produced by Different Manufacturing Processes," Transactions of the ASME, vol. 129, pp. 586-594, Jul. 2007.

PMF Industries, Understanding Flowforming web archived Oct. 13, 2004 (http://web.archive.org/web/20041013173007/http://www.pmfind.com/Flowforming/Flowforming/Flowforming-6-04.pdf).

McMullen, "Application of Sub-Models to Explore Geometric Effects in Medium Caliber Gun Barrels," Concurrent Technologies Corporation (Date Unknown), 19 pages.

Antunes et al., "Influence of Stress State on High Temperature Fatigue Crack Growth in Inconel 718," Fatigue & Fracture of Engineering Materials & Structures, 24 (2001), pp. 127-135.

Koch et al., "Seamless Thin-Walled TiAl6V4 Tubes Manufactured by Flow-Forming Process," Titanium '92, Science and Technology, The Minerals, Metals & Materials Society (1993), pp. 1429-1436.

Rifling by Flow Forming: A New Developed Method for Rifling Barrels, 2007, (http://www.macdor.com/technical_documents/Rifling_by_flow_forming.pdf.

Rifling: Facts, Discussion Forum, and Encyclopedia Article, printed Jun. 16, 2009, (http://www.absoluteastronomy.com/topics/Rifling).

(56) References Cited

OTHER PUBLICATIONS

Solicitation/Contract/Order for Commercial Items, Contract No. W15QKN-04-M-0184, Award/Effective Date: Apr. 23, 2004, 2 pages.
Amendment of Solicitation/Modification of Contract, Amendment/Modification No. W15QKN04-M-0184, Effective Date: Jul. 29, 2004, 3 pages.
Solicitation/Contract/Order for Commercial Items, Contract No. W15QKN-05-P-0123, Award/Effective Date: Mar. 10, 2005, 11 pages.
Solicitation/Contract/Order for Commercial Items, Contract No. W15QKN-05-P-0248, Award/Effective Date: Apr. 21, 2005, 10 pages.
Amendment of Solicitation/Modification of Contract, Amendment/Modification No. W15QKN-05-P-0248, Effective Date: Aug. 22, 2005, 2 pages.
Solicitation/Contract/Order for Commercial Items, Contract No. W15QKN-05-P-0312, Award/Effective Date: Jun. 8, 2005, 12 pages.
Amendment of Solicitation/Modification of Contract, Amendment/Modification No. W15QKN-05-P-0312, Effective Date: Aug. 23, 2005, 2 pages.
Amendment of Solicitation/Modification of Contract, Amendment/Modification No. W15QKN-05-P-0312, Effective Date: Oct. 25, 2005, 2 pages.
Drawings for Contract No. W15QKN-04-M-0184, Release Date: Jul. 7, 2004, 2 pages.
Drawings for Contract No. W15QKN-04-M-0184, Release Date: Nov. 2, 2004, 2 pages.
DeFries, Richard S., "Hydrostatic Extrusion of 60MM Mortar Tubes," National Technical Information Service, Oct. 1974.
Gourley, Scott R., "Mortar Technology, Special Operations Technology, Online Edition", retrieved from Internet Dec. 12, 2007: http://www.special-operations-technology.com/article.cfm?DocID=2051, pp. 1-6.
Harlow et al., "Development of an Electrochemical Machining Process for Rifling Lined Gun Barrels," Defense Technical Information Center, Dec. 1972, retrieved from Internet: http://stinet.dtic.mil/oai?& verb=getRecord&metadataPrefix=html& identifier=AS0909379, 1 page.
Kim et al., "Effect of Thermo-Mechanical Treatment on Mechanical Properties and Shape Behavior of Ti-(26-28) at % Nb Alloys", Materials Science and Engineering A, Feb. 6, 2006, pp. 839-843.
Lee et al., "Structure-Property Relationship of Cast Ti-Nb Alloys", Journal of Oral Rehabilitation, Department of Materials Science and Engineering, Blackwell Science Ltd., vol. 29, 2002, pp. 314-322.
Powell, G. W., "Evaluation of Alloys for Use in 81-mm Mortar Tubes; Elevated-Temperature Failures," Failure Analysis and Prevention, vol. 11, ASM Handbook, ASM International, 1986, pp. 263-297.
Drennen et al., "Rotary Swaged Rapid-Fire Gun Barrels", Battelle Memorial Institute, 100 pages, Aug. 1972.
Tillack et al., "Heat Treating of Nickel Alloys", adapted from Heat Treating, ASM Handbook, ASM International, vol. 4, pp. 907-912, 1990.
Prevéy, "The Effect of Cold Work on the Thermal Stability of Residual Compression in Surface Enhanced IN718", Lambda Technologies, 20th ASM Materials Solutions Conference & Exposition, 9 pages, Oct. 10-12, 2000.
Frank, "Selection of Age-Hardenable Superalloys", 13 pages, Jun. 2005.
Cammett et al., "The Effect of Shot Peening Coverage on Residual Stress, Cold Work, and Fatigue in a Nickel-Base Superalloy", Lambda Technologies, Proceedings of ICSP 9, pp. 1-6, Sep. 6-9, 2005.
Liu et al., "Study of Residual Stresses in the Barrel Processed by the Radial Forging", 2009 Second International Conference on Information and Computing Science, IEEE Computer Society, pp. 131-134, 2009.
U.S. Appl. No. 14/103,483, filed Dec. 11, 2013.
Chang, O.W., "Zirconium and Titanium Flowformed Products Offer Myriad of Advantages," Outlook, 1.sup.st Quarter, 1999.
Scutti, J. J., "Flowformed Titanium Tubular Products," Advanced Materials & Processes, Jan. 2001.
Klocke, F., et al., "Laser-Assisted Metal Spinning of Advanced Materials," Fraunhofer Institute of Production Technology IPT, pp. 1-5, 2003.
Fonte, V., "Flowforming of Thin-Walled Tubes and Cylinders," Dynamic Machine Works, Inc., 2001.
Statement regarding prior activities of Dynamic Machine Works, Inc., Oct. 19, 2005.
Da Silva et al., "Dynamic properties of NiTi shape memory alloy and classic structural materials: a comparative analysis", Materials Science Forum vol. 643, 2010, pp. 37-41.
Duerig, et al., Nitinol, Part 1, Mechanism and Behavior, Chapter 9, Alloying and Composition, SMST e-Elastic newsletter, Jan. 2011, ASM International, pp. 1-30.
Littlefield, Andrew and Eric Kathe, "Adaptive Gun Barrel Vibration Absorber", 2002, 12 pages.
NACE Standard MR0175-2000, Standard Material Requirements, Sulfide Stress Cracking Resistant Metallic Materials for Oilfield Equipment, NACE International, 2000, 42 pages.
American Petroleum Institute Specification 5LD "Specifications for CRA Clad or Lined Steel Pipe," 3d edition, 2009, 48 pages.
ASTM A264—12 Standard Specification for Stainless Chromium-Nickel Steel-Clad Plate, Section 7.2.1 Shear Strength, 2012, 6 pages.

* cited by examiner

Damping capacity as a function of temperature for the NiTi SMA and some classical Storage modulus percentage variation with temperature in SMA NiTi and some classical materials.

Austenite phase, martensite phase and deformed martensite phase

Deformation mechanisms of NiTi with temperature T>As $M_d$ defines the upper limit of the "pseudoelastic" region

*Effects of Pt and Pd additions to Nitinol (Data from [34].)*

*Zirconium and hafnium stabilize the martensite when substituted for titanium in nickel-poor alloys. Solid symbols represent $M_s$ measurements from a 50at.% nickel alloy [30]. Open squares represent $M_s$ data (peak) from a 49at.% nickel alloy (data from reference [37]).*

COMPOSITE GUN BARREL WITH OUTER SLEEVE MADE FROM SHAPE MEMORY ALLOY TO DAMPEN FIRING VIBRATIONS

REFERENCE TO PENDING PRIOR PATENT APPLICATIONS

This patent application claims priority under 35 U.S.C. §120 from pending U.S. patent application Ser. No. 13/411,290, filed Mar. 2, 2012, which in turn claims priority under 35 U.S.C. §119(e) from U.S. Provisional Patent Application Ser. No. 61/448,237, filed Mar. 2, 2011. Each of the foregoing patent applications is hereby incorporated herein by reference.

FIELD OF THE INVENTION

This invention relates to gun barrels in general, and more particularly to a composite gun barrel with an outer sleeve made from a shape memory alloy to dampen firing vibrations.

BACKGROUND OF THE INVENTION

With the advent of flowformed superalloy gun barrels, the gun barrels can handle hotter barrel temperatures and be made thinner and lighter. However, the thinner the gun barrel, the more susceptible it is to deflection from firing vibrations, thereby rendering the gun barrel less accurate. With machine guns that "spray" the target, this may not be a big problem, but with rifles in general, and with sniper rifles in particular, this can be a significant problem. In fact, the barrels of sniper rifles typically do not get particularly hot since relatively few shots are fired at a time. For this reason, heat management is generally not a significant issue with the barrels of sniper rifles. However, vibration damping is a major issue as it relates to the barrel accuracy of sniper rifles. Today, the barrels of sniper rifles are sometimes up to an inch thick to dampen vibrations from firing.

In addition to snipers, almost any gun user (e.g., general infantry, sportsman, law enforcement officer, etc.) would generally prefer to dampen firing vibrations in their gun barrel so as to increase the accuracy of the gun barrel, so long as the means for dampening the firing vibrations did not add excessive weight, size, complexity and/or cost to the gun barrel.

SUMMARY OF THE INVENTION

The present invention comprises the provision and use of a novel composite gun barrel which comprises novel means for dampening firing vibrations in the gun barrel so as to increase the accuracy of the gun barrel without significantly adding to the weight, size, complexity and/or cost of the gun barrel. More particularly, the novel composite gun barrel comprises an inner rifled liner tube and an outer sleeve made from a shape memory alloy (SMA), with the inner rifled liner tube guiding the projectiles (e.g., bullets) and the SMA outer sleeve dampening the firing vibrations carried by the inner rifled liner tube. This construction is highly effective, since SMAs have superior dampening properties compared to conventional structural materials. The SMA outer sleeve can be shrunken onto the inner rifled liner tube using a one-way shape memory effect (shape memory contraction) or by using the SMA's superelastic properties to couple the SMA outer sleeve to the inner rifled liner tube. In either case, because the SMA outer sleeve is in compression with the inner rifled liner tube, the SMA outer sleeve acts as a column, for which a round tube is the most structurally efficient configuration. As a result of the aforementioned composite construction, the composite gun barrel's column rigidity (as measured by the ratio of its length to its "radius gyration") is increased relative to a conventional gun barrel. This increase in column rigidity increases the natural frequency of the firing vibrations, thereby lowering the amplitude of the firing vibrations, while also providing a constraint or restriction to transverse vibrations at the muzzle of the gun barrel. Thus, firing vibrations in the gun barrel are significantly dampened. Additionally, and significantly, the SMA-based composite gun barrel takes advantage of the SMA's unique ability to recover from large strains due to a solid-solid phase transformation, and to dissipate energy because of the resulting internal friction of the SMA. In this respect it will be appreciated that NiTi SMAs, otherwise known as Nitinol, have become the most popular SMAs due to their favorable properties including hysteretic damping and large strain recovery. By utilizing an SMA outer sleeve, the novel composite gun barrel of the present invention can be made thinner and lighter than today's heavy, monolithic steel gun barrels. Furthermore, because of the increased flexural rigidity and damping properties of the novel composite gun barrel of the present invention, the composite gun barrels are more accurate than conventional monolithic steel gun barrels.

In one preferred form of the invention, there is provided a composite gun barrel comprising: an inner rifled liner tube having an outer surface; and an outer sleeve made from a shape memory alloy and having an inner surface for disposition against the outer surface of the inner rifled liner tube; wherein the inner rifled liner tube is configured for guiding projectiles and the outer sleeve is configured for dampening the firing vibrations encountered by the inner rifled liner tube.

In another preferred form of the invention, there is provided a method for forming a composite gun barrel, the method comprising: providing an inner rifled liner tube having an outer surface, and providing an outer sleeve made from a shape memory alloy and having an inner surface; and disposing the outer sleeve about the inner rifled liner tube so that the inner surface of the outer sleeve substantially engages the outer surface of the inner rifled liner tube.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein:

FIG. 5 is a schematic view showing deformation mechanisms of NiTi with temperature T>As;

DETAILED DESCRIPTION OF THE PREFERRED EMBODIMENTS

Figure 1:
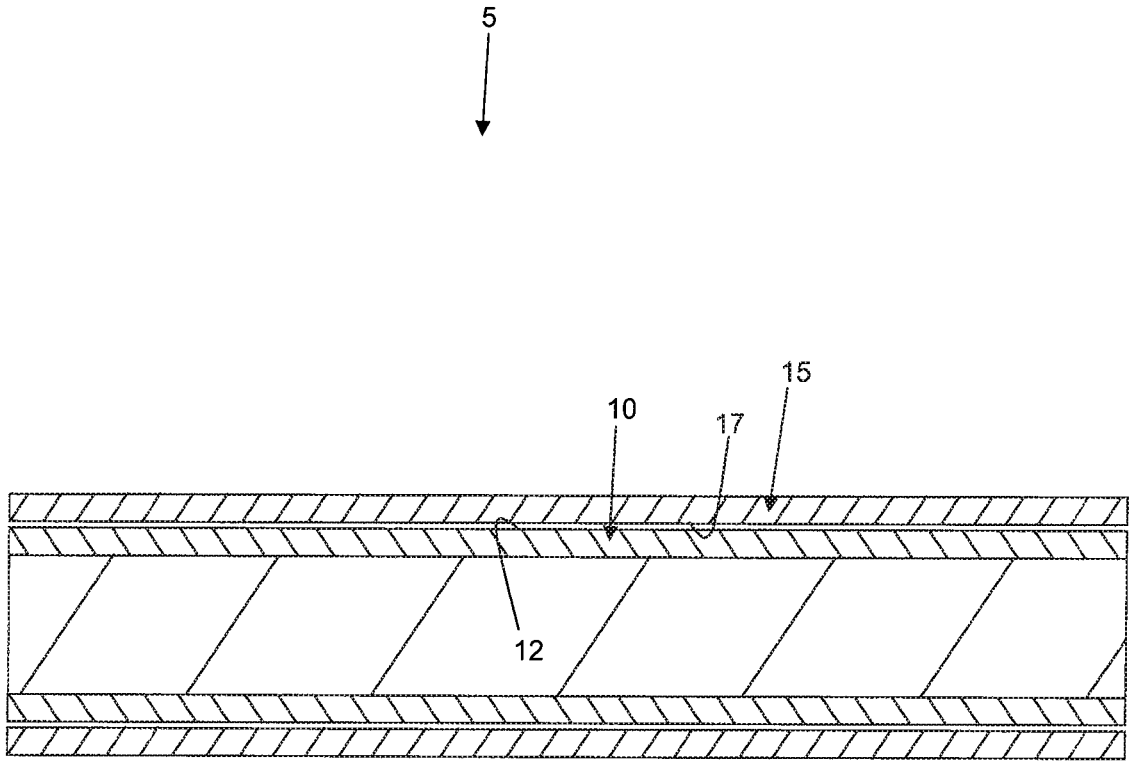
FIG. 1 is a schematic view showing a composite gun barrel formed in accordance with the present invention.

Looking first at FIG. 1, there is shown a novel composite gun barrel 5 formed in accordance with the present invention. Composite gun barrel 5 comprises an inner rifled liner tube 10 having an outer surface 12, and an outer sleeve 15 made from a shape memory alloy (SMA) and having an inner surface 17 for disposition against outer surface 12 of inner rifled liner tube 10, with inner rifled liner tube 10 guiding the projectiles (e.g., bullets) and SMA outer sleeve 15 dampening the firing vibrations carried by inner rifled liner tube 10. This construction is highly effective, since SMAs have superior dampening properties compared to conventional structural materials. SMA outer sleeve 15 can be shrunken onto inner rifled liner tube 10 using a one-way shape memory effect (shape memory contraction) or by using the SMA's superelastic properties to couple SMA outer sleeve 15 to inner rifled liner tube 10. I n either case, because SMA outer sleeve 15 is in compression with inner rifled liner tube 10, SMA outer sleeve 15 acts as a column, for which a round tube is the most structurally efficient configuration. As a result of the aforementioned composite construction, the composite gun barrel's column rigidity (as measured by the ratio of its length to its "radius gyration") is increased relative to a conventional gun barrel. This increase in column rigidity increases the natural frequency of the firing vibrations, thereby lowering the amplitude of the firing vibrations, while also providing a constraint or restriction to transverse vibrations at the muzzle of the gun barrel. Thus, firing vibrations in the gun barrel are significantly dampened. Additionally, and significantly, the SMA-based composite gun barrel 5 takes advantage of the SMA's unique ability to recover from large strains due to a solid-solid phase transformation, and to dissipate energy because of the resulting internal friction of the SMA. In this respect it will be appreciated that NiTi SMAs, otherwise known as Nitinol, have become the most popular SMAs due to their favorable properties including hysteretic damping and large strain recovery. By utilizing an SMA outer sleeve 15, composite gun barrel 5 can be made thinner and lighter than today's heavy, monolithic steel gun barrels. Furthermore, because of the increased flexural rigidity and damping properties of composite gun barrel 5, the composite gun barrel is more accurate than conventional monolithic steel gun barrels.

Dampening Capacities of SMAs

It is known that the high damping capacity of the thermoelastic martensitic phase of an SMA is related to the hysteretic movement of interfaces in the alloy (martensite variant interfaces and twin boundaries).

Also, the damping capacity of an SMA depends directly on external variables such as the heating rate of the SMA, the frequency of the vibrations being dampened by the SMA and the amplitude of the vibrations being dampened by the SMA; and internal variables such as the type of SMA material, grain size, martensite interface density and structural defects. In SMAs, a high damping capacity and a low storage modulus in the martensitic state is observed. It has been verified that during phase transformation, there is the presence of a peak in damping capacity and an equivalent increase of storage modulus. The storage modulus, represented by the elastic component and related to a material's stiffness, is also superior with SMAs.

Figure 2:
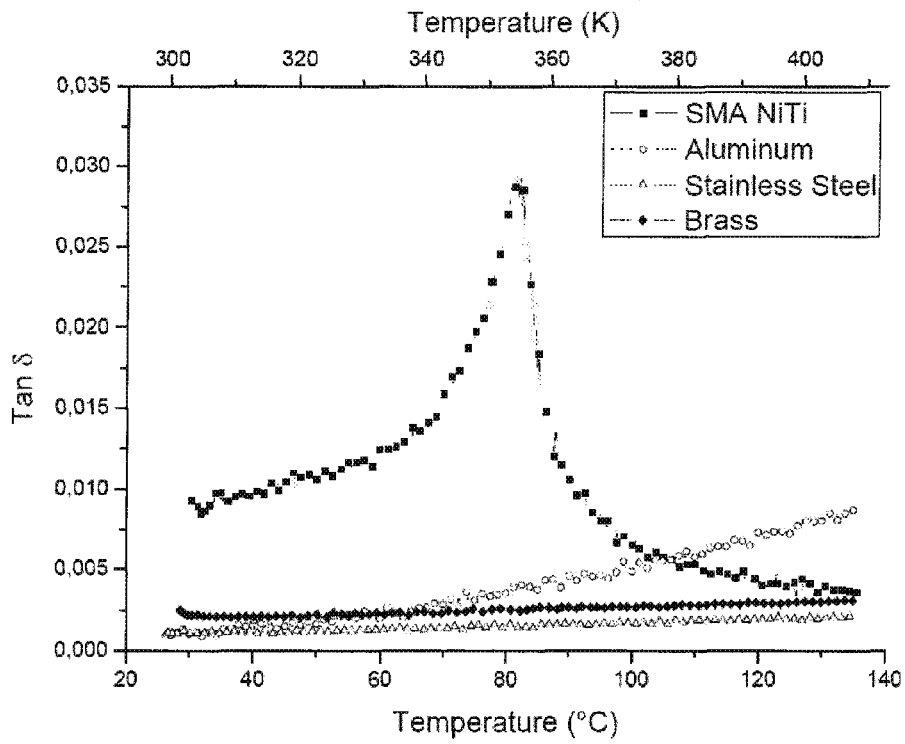
FIG. 2 is a schematic view showing the damping capacity of NiTi as a function of temperature.

A comparative study on the dynamic properties of active and structural materials was carried out and clearly demonstrates the superiority of SMA damping behavior over classical structural materials under the same external conditions. Among other things, NiTi SMA specimens were compared to commercial aluminum, stainless steel and brass specimens (as examples of classical materials). All beam specimens were submitted to Dynamic Mechanical Analysis (DMA) tests using a commercial apparatus in a single cantilever mode under temperature variation. Damping capacity and storage-modulus variation were analyzed, as seen in FIG. 2.

The damping behavior of all specimens was observed, with the NiTi SMA, aluminum, stainless steel and brass specimens being submitted to a temperature ramp of 5° C./min, with a frequency of 1 Hz and 5 μm of oscillation amplitude. The NiTi SMA showed, in the martensitic state (i.e., between room temperature and about 70° C.), a higher damping capacity by comparison to the other materials studied. This difference in damping capacity increases even more in the phase transformation temperature range (i.e., between 70° C. and 90° C.), when the NiTi SMA specimen presents a significant peak in its damping capacity, while aluminum, stainless steel and brass samples present relatively modest, incremental increases in their damping capacity. For temperatures greater than 90° C., the NiTi SMA is substantially completely transformed to the austenitic state, which intrinsically presents smaller energy absorption than the martensitic state.

The fact that the NiTi SMA alloy is in its fully austenitic state explains the decrease in its damping capacity in this temperature range, as compared to the damping capacity of the NiTi SMA alloy when it is in its martensitic state. Better damping capacity values can also be obtained from the NiTi SMA as the oscillation amplitude and/or frequency decreases and as the heating rate increases.

Figure 3:
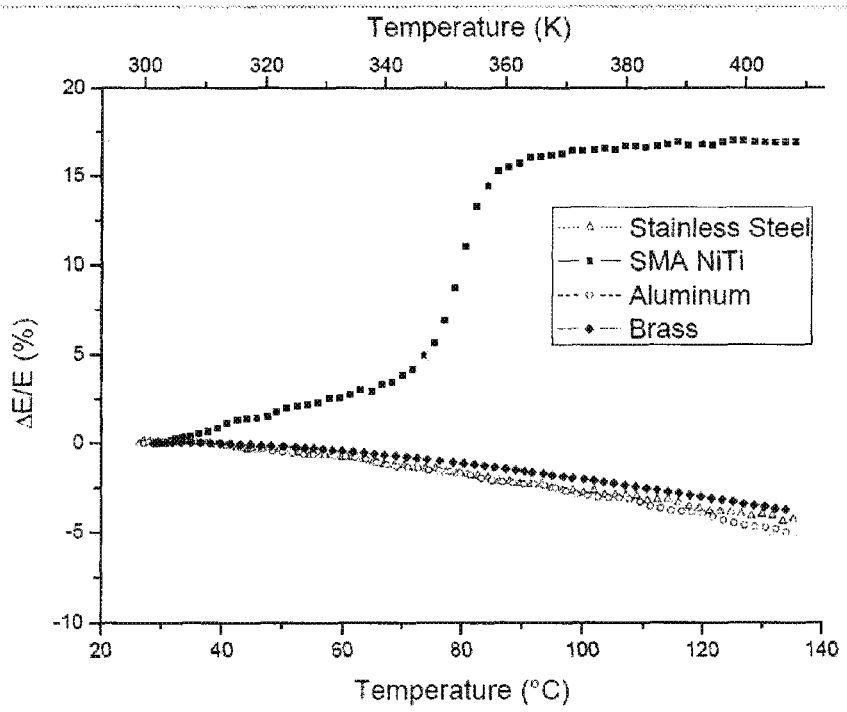
FIG. 3 is a schematic view showing the storage modulus of NiTi as a function of temperature.

The storage modulus variation is better visualized in relation to room temperature, as seen in FIG. 3. More particularly, classical materials (e.g., aluminum, stainless steel and brass) exhibit a 5% reduction in storage modulus, whereas the NiTi SMA exhibits a 17% increase in storage modulus.

This comparative study shows the high damping capacity of the NiTi SMA in the martensitic state and during phase transformation. Even better damping values can be obtained from the NiTi SMA as the oscillation amplitude, frequency and heating rate vary. The study also shows a significant increase in storage modulus during phase transformation.

Significantly, and in accordance with the present invention, this damping characteristic of SMAs can be used to design new and improved gun barrels that exhibit greatly improved stiffness control, whereby to achieve significantly improved gun barrel accuracy.

Shape Memory Alloys (SMAs)

Nickel-titanium shape memory metal alloys, also known as Nitinol (NiTi), are functional materials whose shape and stiffness can be controlled with temperature. With an appropriate change in temperature, the metal undergoes a complex crystalline-to-solid phase change called martensite-austenite transformation. As the metal in the high-temperature (austenite) phase is cooled, the crystalline structure enters the low-temperature (martensite) phase, where it can be easily bent and shaped. As the metal is re-heated back above its transition temperature, its original shape and stiffness are restored.

SMA materials exhibit various characteristics depending on the composition of the alloy and its thermal-mechanical work history. The material can exhibit 1-way or 2-way shape memory effects. A 1-way shape-memory effect results in a substantially irreversible change upon crossing the transition temperature, whereas a 2-way shape memory effect allows the material to repeatedly switch between alternate shapes in response to temperature cycling.

SMAs can recover large strains in two ways: (i) shape memory effect (SME), and (ii) pseudoelasticity, which is also known as superelasticity (SE). The NiTi family of alloys can withstand large stresses and can recover strains near 8% for low cycle use or up to about 2.5% strain for high cycle use.

The shape memory alloys, when considered as functional materials, show two unique capabilities which are absent in traditional materials: shape memory effect (SME) and superelasticity (SE). Both SME and SE largely depend on the solid-solid, diffusionless phase transformation process known as martensitic transformation (MT) from a crystallographically more-ordered parent phase (austenite) to a crystallographically less-ordered product phase (martensite).

Figure 4:
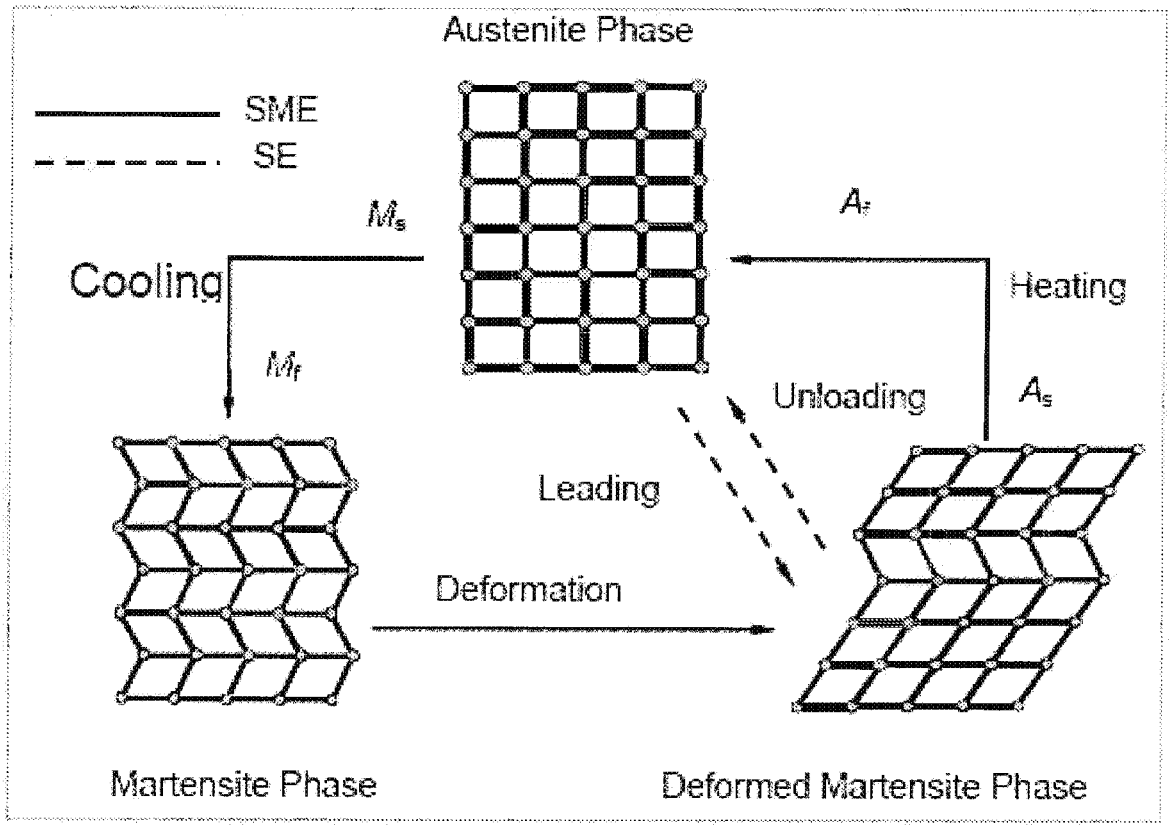
FIG. 4 is a schematic view showing the interrelationship between the austenite phase, martensite phase and deformed martensite phase of a shape memory alloy.

The phase transformation (from austenite to martensite, or vice versa) is typically marked by four transition temperatures, generally characterized as Martensite finish (Mf), Martensite start (Ms), Austenite finish (Af), and Austenite start (As). For purposes of illustration, assume that for an SMA, the transition temperatures are related as follows: Mf<Ms<As<Af. Thus, a change in the temperature (T) within Ms<T<As induces no phase change and both martensite and austenite may coexist within Mf<T<Af. The phase transformations may take place depending on changing temperature (SME) or changing stress (SE), seen in FIG. 4.

Upon cooling, Nitinol will transform from a high-temperature austenite phase to a low-temperature martensite phase via an intermediate phase, known as the R-phase. The crystal structure of the parent austenite phase is cubic and, when cooled, the lattice elongates along one of its diagonals. This reduces the cube angle and produces a rhombohedral structure (hence the name R-phase). For an R-phase to occur, the martensite transformation must be suppressed relative to the creation of the R-phase. This can be achieved by solution annealing and ageing heat treatments in order to introduce NiTi precipitates that promote the R-phase growth. If this structure is cooled below a critical temperature, Rs, R-phase crystals form near the NiTi particles and the resulting microstructure will consist of both austenite and R-phase components and is known as the pre-martensite phase. Further cooling of the material below the Ms temperature will initiate martensite formation, with twinned martensite forming in pre-martensite structure. In the reverse transformation from martensite to the parent austenite phase, the transformation will occur in a single step, with the material showing a stable phase above the Af temperature.

Shape Memory Effect (SME)

For T>Af, the SMA is in the parent austenite phase with a particular size and shape. Under stress-free conditions, if the SMA is cooled to any temperature T<Mf, martensitic transformation (MT) occurs as the material converts from the parent austenite phase to the product martensite phase. MT is basically a macroscopic deformation process, though actually no transformation strain is generated due to the so-called self-accommodating twinned martensite.

If a mechanical load is applied to this material and the stress reaches a certain critical value, the pairs of martensite twins begin "detwinning" (conversion) to the stress-preferred twins. The "detwinning" or conversion process is marked by the increasing value of strain with insignificant increase in stress. The multiple martensite variants begin to convert to a single variant, with the preferred variant being determined by alignment of the habit planes with the axis of loading. Inasmuch as the single variant of martensite is thermodynamically stable at T<As, upon unloading there is no reconversion to multiple variants and only a small elastic strain is recovered, leaving the material with a large residual strain (plastic). Next, if the deformed SMA is heated above Af, the SMA transforms to the parent austenite phase (which has no variants), the residual strain is fully recovered and the original geometric configuration is restored. It happens as if the material recalls its original shape "from memory" and fully recovers. Therefore, this phenomenon is termed shape memory effect (1-way SME). However, if some end constraints are used to prevent this free recovery back to the original shape, the material generates large tensile recovery stress, which can be exploited as an actuating force for active or passive control purpose (e.g., closing a valve, etc.).

Superelasticity (SE)

The second feature of SMAs is pseudoelasticity, which is also known as superelasticity (SE). The superelastic SMA has the unique capability to fully regain an original shape from a deformed state when the mechanical load that causes the deformation is withdrawn. For some superelastic SMA materials, the recoverable strains can be on the order of 10%. This phenomenon, sometimes referred to as pseudoelasticity or superelasticity (SE), is dependent on the stress-induced martensitic transformation (SIMT), which in turn depends on the states of temperature and stress of the SMA. To explain the SE property of the SMA, consider the case when an SMA (that has been entirely in the parent phase T>Af) is mechanically loaded. Thermodynamic considerations indicate that there is a critical stress at which the crystal phase transformation, from austenite to martensite, can be induced. Consequently, the martensite is formed because the applied stress substitutes for the thermodynamic driving force usually obtained by cooling for the case of the shape memory effect (SME). The load, therefore, imparts an overall deformation to the SMA element as soon as a critical stress is exceeded. During unloading, because of the instability of the martensite at this temperature in the absence of stress, again at a critical level of stress, the reverse phase transformation starts, i.e., from the stress-induced martensite (SIM) phase to the parent austenite phase. When the phase transformation is complete, the SMA is returned to its parent austenite phase. Therefore, superelastic SMAs typically exhibit a hysteresis loop (known as pseudoelasticity or superelasticity) and, if the strain during loading is fully recoverable, the hysteresis loop is a closed one. It should be noted that SIMT (or the reverse SIMT) are marked by a reduction of the material stiffness. Typically the austenite phase of the SMA has a much higher Young's modulus than the martensite phase of the SMA.

For T<As, there is no pseudoelastic recovery and the residual strain can be recovered by heating above Af (SME). For any temperature, there exists a critical stress for irreversible plastic slip to occur in the material (this critical stress value decreases with increasing temperature), and if the critical stress is exceeded so that irreversible plastic slip occurs, then the residual strain cannot be recovered by heating or unloading.

Figure 5:
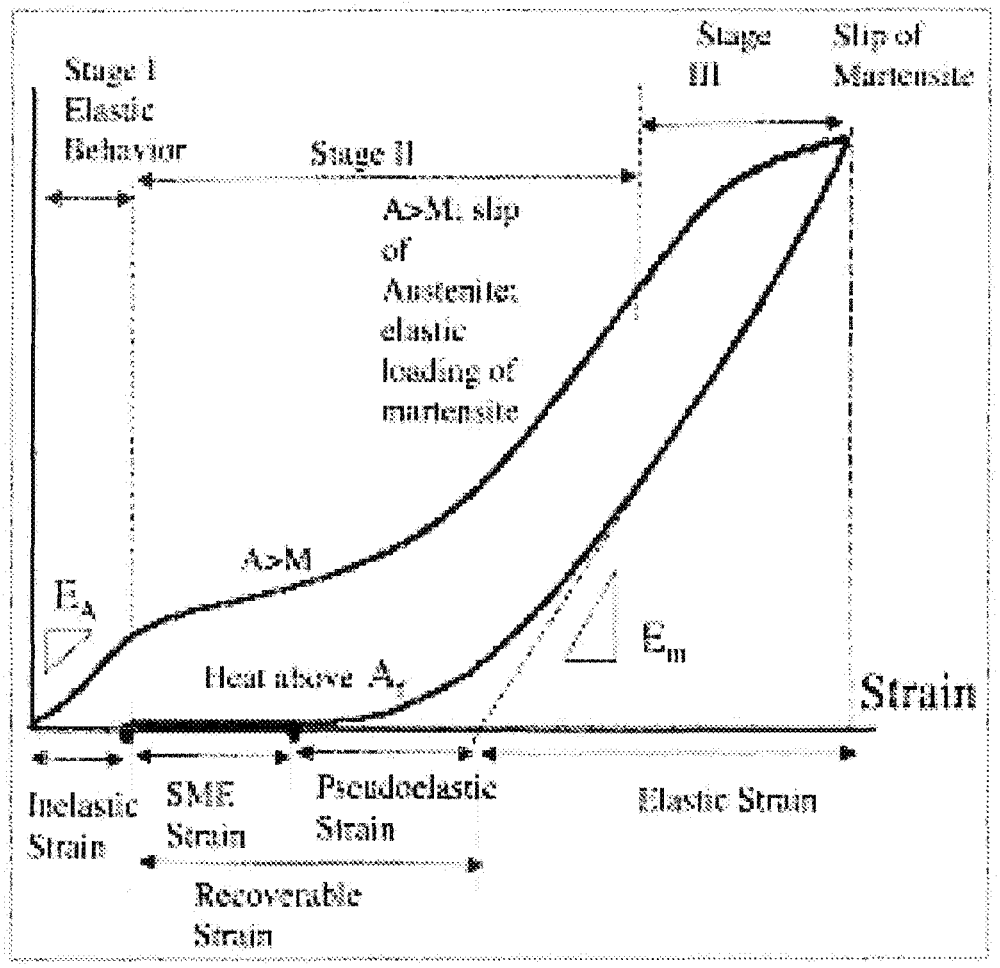

Thus it will be seen that the shape memory effect (SME) occurs by virtue of temperature induced martensitic transformation, whereas the superelasticity effect (SE) occurs because of stress induced martensitic transformation (SIMT). The recoverable strain is defined as the sum of the pseudoelastic strain and the shape memory effect strain. FIG. 5 shows a schematic of the deformation mechanisms and the strain definitions in single crystals.

Novel Use of SMAs in a Composite Gun Barrel

As seen in FIG. 1, the present invention comprises a novel composite gun barrel 5. Composite gun barrel 5 comprises an inner rifled liner tube 10 having an outer surface 12, and an outer sleeve 15 made from a shape memory alloy (SMA) and having an inner surface 17 for disposition against outer surface 12 of inner rifled liner tube 10, with the inner rifled liner tube guiding the projectiles (e.g., bullets) and the SMA outer sleeve 15 dampening the firing vibrations carried by inner rifled liner tube 10, whereby to increase the accuracy of the gun barrel. This vibration damping is achieved by utilizing the superior damping characteristics associated with the shape memory alloy used to form outer sleeve 15, and particularly the superior damping characteristics associated with the shape memory alloy while the shape memory alloy is in its martensitic state.

SMA outer sleeve 15 can be shrunken onto inner rifled liner tube 10 using a one-way shape memory effect (shape memory contraction) or by using the SMA's superelastic properties to couple SMA outer sleeve 15 to inner rifled liner tube 10. In either case, because SMA outer sleeve 15 is in compression with inner rifled liner tube 10, SMA outer sleeve 15 acts as a column, for which a round tube is the most structurally efficient configuration. As a result of the aforementioned composite construction, the composite gun barrel's column rigidity (as measured by the ratio of its length to its "radius gyration") is increased relative to a conventional gun barrel. This increase in column rigidity increases the natural frequency of the firing vibrations, thereby lowering the amplitude of the firing vibrations, while also providing a constraint or restriction to transverse vibrations at the muzzle of the gun barrel. Thus, firing vibrations in the gun barrel are significantly dampened. Additionally, and significantly, the SMA's unique ability to recover from large strains due to a solid-solid phase transformation, and to dissipate energy because of the resulting internal friction of the SMA. In this respect it will be appreciated that NiTi SMAs, otherwise known as Nitinol, have become the most popular SMAs due to their favorable properties including hysteretic damping and large strain recovery. By utilizing an SMA outer sleeve 15, composite gun barrel 5 can be made thinner and lighter than today's heavy, monolithic steel gun barrels. Furthermore, because of the increased flexural rigidity and damping properties of composite gun barrel 5, the composite gun barrel is more accurate than conventional monolithic steel gun barrels.

In one preferred form of the invention, SMA outer sleeve 15 is formed so that it normally has a smaller inside diameter than the outside diameter of inner rifled liner tube 10. In one form of the invention, SMA outer sleeve 15 is cooled and deformed in its martensitic state so that it temporarily has a larger inside diameter than the outside diameter of inner rifled liner tube 10. By way of example but not limitation, a larger, inner mandrel (not shown) is driven into the center bore of SMA outer sleeve 15, which will expand the center bore sufficiently for the SMA outer sleeve to slip-fit over the steel or superalloy inner rifled liner tube 10. Normally, all or a portion of the imparted strain can be recovered during heating—that is, if nothing interferes with this process ("free recovery"). However, the presence of inner rifled liner tube 10 within the center bore of SMA outer sleeve 15 prevents the SMA outer sleeve 15 from fully recovering to its "free recovery" condition.

Thus, in a preferred form of the present invention, the SMA outer sleeve 15 is expanded in the martensitic state, then through SME shrunk onto the inner rifled liner tube 10 which prevents complete recovery. The SMA outer sleeve 15 will freely recover until contact is made with the outside surface of the inner rifled liner tube 10, whereupon the SMA outer sleeve 15 is rigidly constrained and generates a large compressive stress. The inner rifled liner tube 10 substrate may be deformed elastically or plastically by the overlying SMA outer sleeve 15, depending on its own mechanical properties and the magnitude of the internal stresses developed by the compressing SMA outer sleeve.

To quantify the constrained recovery event, the stress-temperature profile must be introduced in conjunction with stress-strain and strain temperature perspectives. A typical range of recovery stress for Nitinol is 450-900 MPa. The constrained recovery leaves the Nitinol outer sleeve 15 in the austenitic phase with some retained martensite. The SMA will not reach the full austenite condition until it reaches its Austenitic finish (Af) temperature or until free recovery is achieved. This is a significant aspect of the present invention, since the retention of at least some martensite in the SMA outer sleeve 15 provides an unusually high damping of the inner rifled liner tube 10 during firing, which in turn leads to increased accuracy for the gun barrel.

Figure 6:
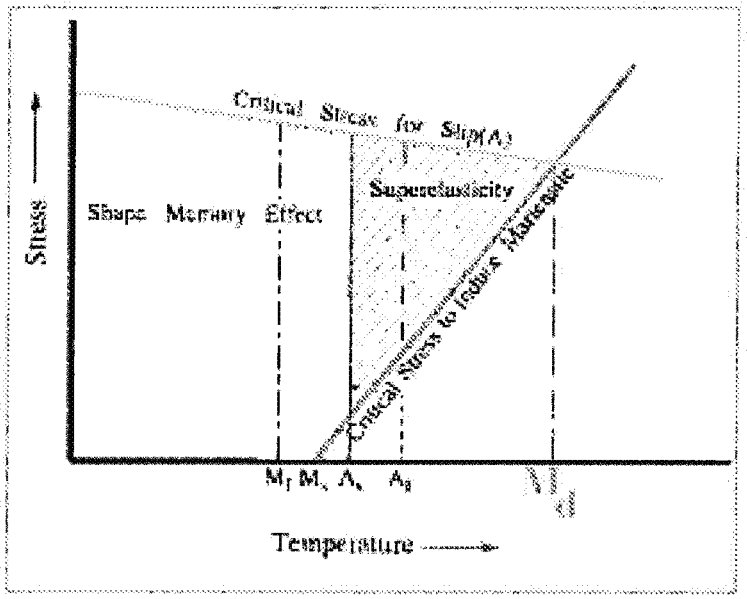
FIG. 6 is a schematic view showing SMA characteristics, including the regions of superelasticity and shape memory effect.

The temperature range for causing the SMA to recover its shape starts just above the Austenite start (As) temperature and the SMA will continue recovering its shape until it reaches its Austenite finish (Af) temperature or until the critical stress to induce martensite is reached (Md). See FIG. 6. In this respect it should be appreciated that both martensite and austenite (superelastic) SMAs have excellent damping capacities, benefiting from their hysteretic stress-strain relationships. However, martensite SMA has an even larger damping capacity than austenite, so in many cases it will be preferred to have a substantial amount of martensite remaining in the SMA after the SMA outer sleeve 15 has been compressively fit over inner rifled liner tube 10. At the same time, austenite that is superelastic has a strong re-centering force to restore its initial shape, which can help to straighten the barrel during firing vibrations. Thus, it can also be desirable to have a substantial amount of austenite in the SMA when SMA outer sleeve 15 is mounted to the inner rifled liner tube 10.

During firing, the steel or superalloy inner rifled liner tube 10 will expand from internal hoop stress pressures, and from material thermal expansion, and will vibrate and whip. The SMA compressive forces provided by SMA outer sleeve 15 will help to improve the barrel's dynamic stability.

SMA outer sleeve 15 can be engineered so as to have co-existing phases, by toggling between (i) martensite at room temperature and (ii) austenite when heat from the barrel is emitted during firing.

In one preferred form of the invention, SMA outer sleeve 15 will have some retained martensite when the barrel is in its "cool, pre-shooting" condition; at least some of the retained martensite in SMA outer sleeve 15 will "flip" to austenite during barrel "heating" (i.e., during shooting of the gun); and then return to some martensite when the barrel cools again. Thus, in this form of the invention, the peak damping characteristics of the NiTi outer sleeve can be harnessed for significant barrel damping as the NiTi outer sleeve toggles between martensite/austenite phases.

A ternary material can be added to the Nickel-Titanium (Nitinol) alloy to keep SMA outer sleeve 15 mostly martensitic during firing, even at high temperatures. Engineering the transformation temperature to be at the steady state firing temperature will maximize damping. Utilizing this peak damping performance at the transition temperatures will greatly increase the accuracy of the barrel. When SMA outer sleeve 15 is in the constrained recovery phase (i.e., as it shrinks down around inner rifled liner tube 10), SMA outer sleeve 15 is primarily austenitic but will intentionally retain some martensite for improved damping qualities. This can be achieved by choosing an SMA with an As temperature above room temperature.

Utilizing a Ternary Element to Drive Up the SMA's Martensitic Start Temperature

The best damping action for a shape memory alloy occurs when the shape memory alloy is in its martensitic condition. Thus, when forming a composite gun barrel comprising an inner rifled liner tube 10 and an SMA outer sleeve 15, it is generally preferable that the NiTi dampening sleeve remain in its martensitic state even when the gun is fired and the barrel gets hot. In order to maintain the martensitic condition longer (i.e., as the temperature of the gun barrel increases), the NiTi can be doped with a small amount of a ternary element in order to raise the transformation temperature of the shape memory alloy.

Palladium, platinum, hafnium and zirconium are all materials that can be used to increase the Martensite Start (Ms) temperature of the SMA from around body temperature (35° C.) to as high as 1,000° C. Zirconium is the cheapest of the four candidate materials and is generally adequate for the barrel application.

Figure 7:
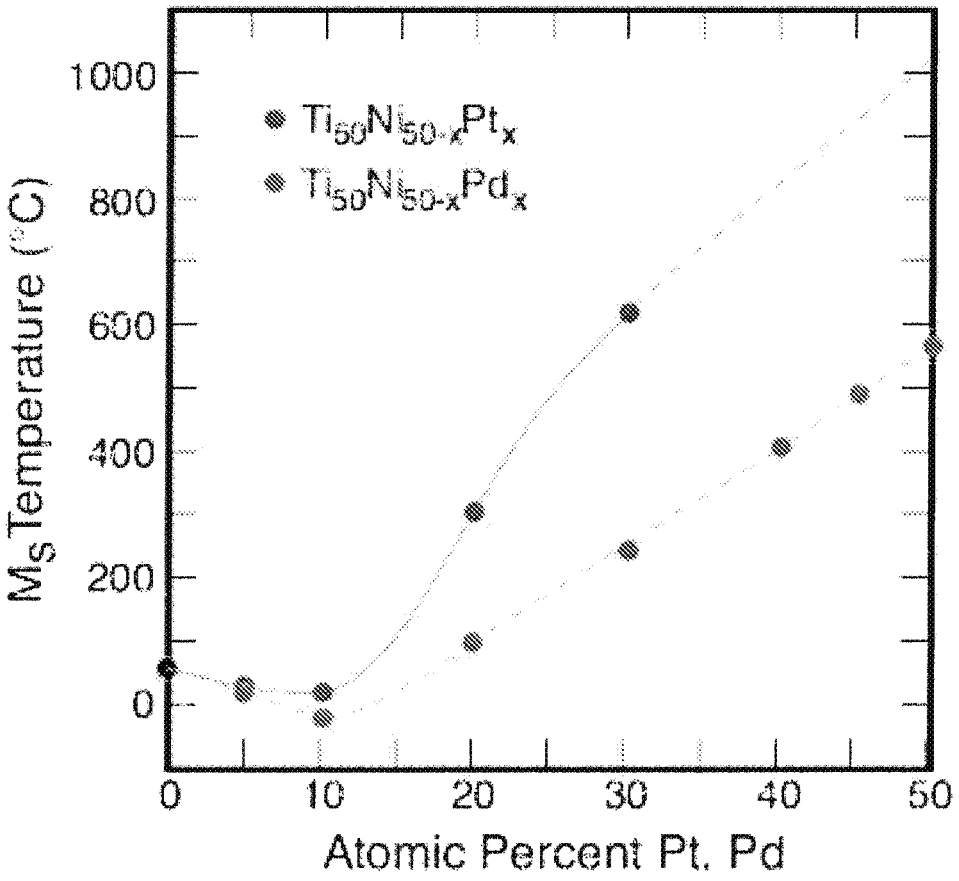
FIG. 7 is a schematic view showing the effects of Pt and Pd additions to Nitinol.
Figure 8:
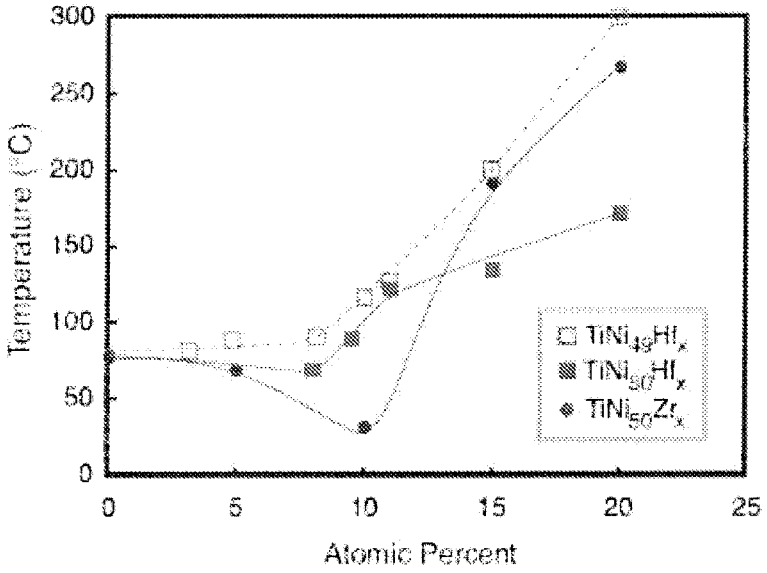
FIG. 8 is a schematic view showing how zirconium and hafnium stabilize the martensite state when substituted for titanium in nickel-poor alloys.

See FIGS. 7 and 8, which show how a ternary material can be added to the SMA to adjust its transition temperatures.

Additional Concepts

Figure 9:
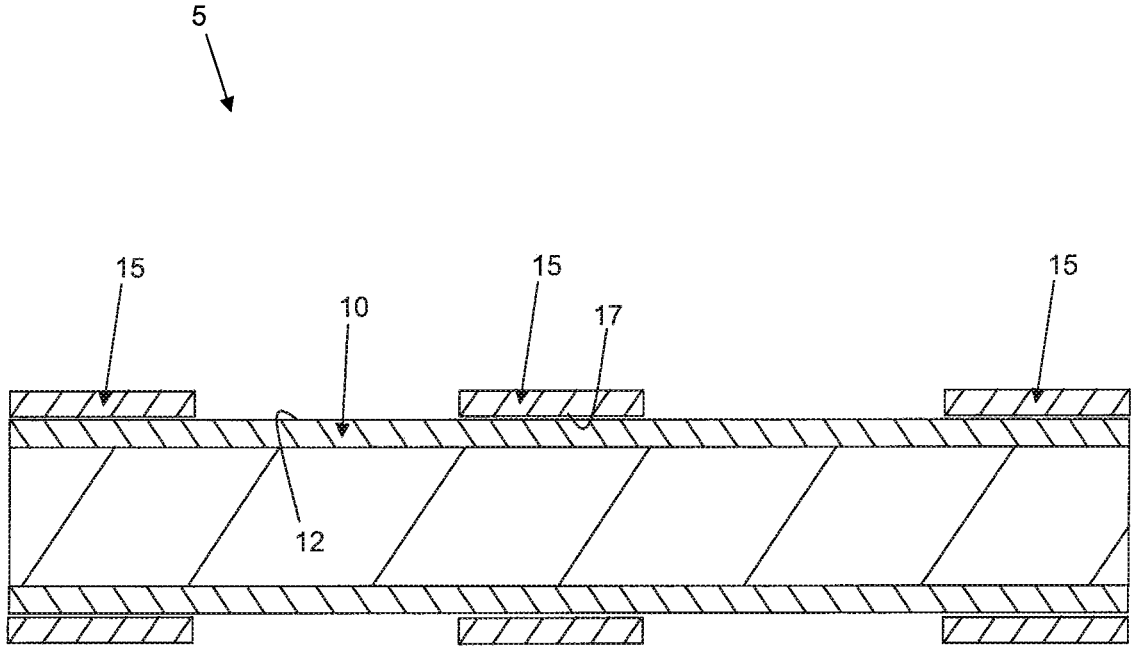
FIG. 9 is a schematic view showing another composite gun barrel formed in accordance with the present invention.

It should be appreciated that SMA outer sleeve 15 can extend along substantially the entire length of inner rifled liner tube 10 (e.g., in the manner shown in FIG. 11), or it can extend along only a portion of the length of inner rifled liner tube 10. In one form of the invention, a plurality of SMA outer sleeves 15 may be disposed along the length of rifled inner barrel 10. See, for example, FIG. 9.

Significantly, the length(s) of the one or more SMA outer sleeve(s) 15, and/or their relative disposition(s) along inner rifled liner tube 10, may be coordinated with the nature (e.g., waveforms) of the vibrations carried by inner rifled liner tube 10 so as to maximize vibration dampening.

Figure 10:
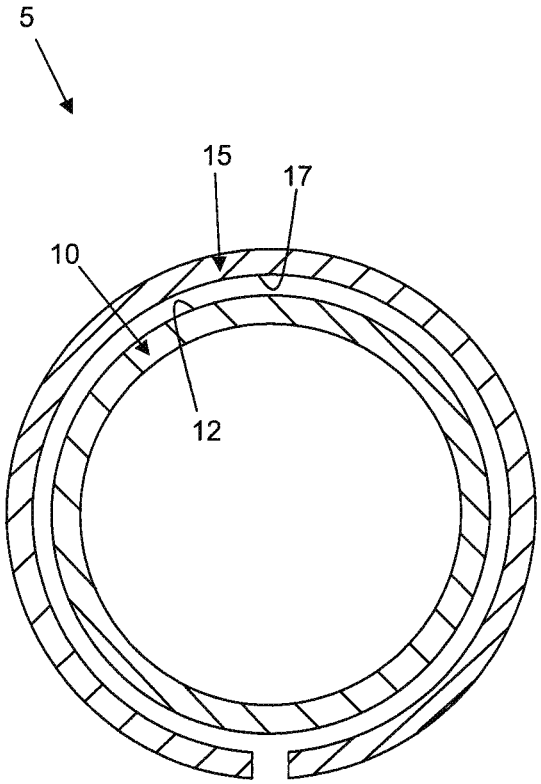
FIG. 10 is a schematic view showing still another composite gun barrel formed in accordance with the present invention.

Furthermore, SMA outer sleeve 15 may be disposed about only a portion of the circumference of inner rifled liner tube 10, e.g., in the manner shown in FIG. 10.

Additionally, in the foregoing description, the SMA alloy has frequently been described as being NiTi (Nitinol). However, it should be appreciated that other, non-Nitinol SMAs may also be used in connection with the present invention.

It is also possible to couple SMA outer sleeve 15 to inner rifled liner tube 10 by conventional mechanical mounts, e.g., via a bayonet mount, a screw mount, a thread mount, etc. In this case, it can sometimes be desirable to form the SMA outer sleeve with a higher martensitic composition.

Modifications

It will be understood that many changes in the details, materials, steps and arrangements of elements, which have been herein described and illustrated in order to explain the nature of the invention, may be made by those skilled in the art without departing from the scope of the present invention.

What is claimed:

1. A composite gun barrel comprising:

an inner rifled liner tube comprising at least one of a steel and a superalloy, the inner rifled liner tube having an outer surface; and an outer sleeve comprising a shape memory alloy and having an inner surface disposed against the outer surface of the inner rifled liner tube, wherein the inner rifled liner tube is configured for guiding projectiles and the outer sleeve extends along only a portion of the circumference of the inner rifled liner tube for dampening the firing vibrations encountered by the inner rifled liner tube.

2. The composite gun barrel of claim 1, wherein the shape memory alloy comprises nickel and titanium.

3. The composite gun barrel of claim 1, wherein the shape memory alloy comprises Nitinol.

4. The composite gun barrel of claim 1, wherein the outer sleeve consists of a shape memory alloy.

5. The composite gun barrel of claim 4, wherein the shape memory alloy comprises nickel and titanium.

6. The composite gun barrel of claim 4, wherein the shape memory alloy is Nitinol.

7. The composite gun barrel of claim 1, wherein at least a portion of the shape memory alloy is in a martensitic state when the composite gun barrel is at ambient temperature.

8. The composite gun barrel of claim 7, wherein at least a portion of the shape memory alloy is in a martensitic state when the composite gun barrel is heated by firing projectiles through the composite gun barrel.

9. The composite gun barrel of claim 1, wherein substantially all of the shape memory alloy is in a martensitic state when the composite gun barrel is at ambient temperature.

10. The composite gun barrel of claim 9, wherein substantially all of the shape memory alloy is in a martensitic state when the composite gun barrel is heated by firing projectiles through the composite gun barrel.

11. The composite gun barrel of claim 1, wherein at least a portion of the shape memory alloy is in the R-phase state when the composite gun barrel is at ambient temperature.

12. The composite gun barrel of claim 11, wherein at least a portion of the shape memory alloy is in the R-phase state when the composite gun barrel is at ambient temperature.

13. The composite gun barrel of claim 1, wherein substantially all of the shape memory alloy is in the R-phase state when the composite gun barrel is at ambient temperature.

14. The composite gun barrel of claim 13, wherein substantially all of the shape memory alloy is in the R-phase state when the composite gun barrel is heated by firing projectiles through the composite gun barrel.

15. The composite gun barrel of claim 1, wherein at least some of the shape memory alloy is in a martensitic state when the composite gun barrel is in a firing, relatively hot condition.

16. The composite gun barrel of claim 1, wherein the outer sleeve is in compression against the outer surface of the inner rifled liner tube.

17. The composite gun barrel of claim 16, wherein the compression of the outer sleeve against the outer surface of the inner rifled liner tube causes at least some of the shape memory alloy to be in a martensitic state when the composite gun barrel is at ambient temperature.

18. The composite gun barrel of claim 1, wherein the outer sleeve extends along substantially the entire length of the inner rifled liner tube.

19. The composite gun barrel of claim 1, wherein the outer sleeve extends along only a portion of the length of the inner rifled liner tube.

20. The composite gun barrel of claim 19, wherein the outer sleeve is positioned on the inner rifled liner tube so as to maximize vibration damping.

21. The composite gun barrel of claim 1 comprising a plurality of outer sleeves, each of the plurality of outer sleeves comprising a shape memory alloy and having an inner surface for disposition against the outer surface of the inner rifled liner tube.

22. The composite gun barrel of claim 21, wherein each of the plurality of outer sleeves is sized and positioned on the inner rifled liner tube so as to maximize vibration damping.

23. A composite gun barrel comprising:

an inner rifled liner tube having an outer surface; and an outer sleeve comprising a shape memory alloy including nickel and titanium and having an inner surface disposed against the outer surface of the inner rifled liner tube;

wherein the inner rifled liner tube is configured for guiding projectiles and the outer sleeve extends along only a portion of the length of the inner rifled liner tube for dampening the firing vibrations encountered by the inner rifled liner tube.

24. The composite gun barrel of claim 23, wherein the shape memory alloy is Nitinol.

25. The composite gun barrel of claim 23, wherein the outer sleeve consists of a shape memory alloy including nickel and titanium.

26. The composite gun barrel of claim 25, wherein the shape memory alloy is Nitinol.

27. A method for forming a composite gun barrel, the method comprising:

providing an inner rifled liner tube comprising at least one of a steel and a superalloy, the inner rifled liner tube having an outer surface;

providing an outer sleeve made from a shape memory alloy and having an inner surface; and disposing the outer sleeve about the inner rifled liner tube along only a portion of the length of the inner rifled liner tube so that the inner surface of the outer sleeve substantially engages the outer surface of the inner rifled liner tube.

28. The method of claim 27, wherein the outer sleeve is compressed about the inner rifled liner tube.

29. The method of claim 27, wherein the compression of the outer sleeve about the inner rifled liner tube causes at least a portion of the shape memory alloy to be in a martensitic state when the composite gun barrel is at ambient temperature.

30. The composite gun barrel of claim 23, wherein the outer sleeve is positioned on the inner rifled liner tube so as to maximize vibration damping.

31. The method of claim 27, wherein the step of disposing the outer sleeve about the inner rifled liner tube comprises positioning the outer sleeve so as to maximize vibration damping.

* * * * *